US006637608B1

(12) United States Patent
Schneider

(10) Patent No.: US 6,637,608 B1
(45) Date of Patent: Oct. 28, 2003

(54) FREESTANDING FRAME FOR SUPPORTING SHELVES

(76) Inventor: Wallace Schneider, 41 W. 72nd St., New York, NY (US) 10023-3483

( * ) Notice: Subject to any disclaimer, the term of this patent is extended or adjusted under 35 U.S.C. 154(b) by 0 days.

(21) Appl. No.: 09/925,517

(22) Filed: Aug. 9, 2001

(51) Int. Cl.[7] ..... A47F 5/08; A47B 47/00

(52) U.S. Cl. ..... 211/90.02; 248/164; 248/277.1; 248/285.1; 248/295.11; 211/195; 211/202; 211/175; 211/189

(58) Field of Search ..... 211/90.02, 202, 211/195, 200, 201, 186, 175, 149, 204, 189; 248/164, 295.11, 285.1, 431, 277.1, 169, 286.1, 171, 296.1, 149, 445, 150, 495; 312/257.1; 108/118, 108, 106, 162, 188, 190, 192, 115, 117; 403/109.1, 109.6, 346, 347, FOR 100, 102; 52/109, 645, 646, 690–692, 79.5, 653.1, 693, 695, 719

(56) References Cited

U.S. PATENT DOCUMENTS

| | | | | | |
|---|---|---|---|---|---|
| 660,290 | A | * | 10/1900 | Corbin | 211/201 |
| 1,008,477 | A | * | 11/1911 | Kohn | 211/204 |
| 1,071,428 | A | * | 8/1913 | Jones | 248/448 |
| 1,071,722 | A | * | 9/1913 | Fitzpatrick | 24/43 |
| 1,184,304 | A | * | 5/1916 | Bellemare et al. | 248/494 |
| 1,382,908 | A | * | 6/1921 | Helka | 248/490 |
| 1,511,805 | A | * | 10/1924 | Dunbar | 38/102.5 |
| 1,635,828 | A | * | 7/1927 | Franzdorf | 108/118 |
| 2,164,299 | A | * | 6/1939 | Mandell et al. | 40/741 |
| 2,557,594 | A | * | 6/1951 | Bryan | 108/118 |
| 2,681,194 | A | * | 6/1954 | Halvorsen | 248/495 |
| 2,852,145 | A | * | 9/1958 | Scholz | 211/204 |
| 3,484,810 | A | * | 12/1969 | Boss | 108/152 |
| 3,655,159 | A | | 4/1972 | Held, Jr. | 248/188.1 |
| 4,197,950 | A | | 4/1980 | Ovitz, III | 211/134 |
| 4,620,489 | A | | 11/1986 | Albano | 108/105 |
| 4,620,683 | A | * | 11/1986 | Claydon et al. | 248/97 |
| 4,679,510 | A | | 7/1987 | Veyhl et al. | 108/152 |
| 4,763,865 | A | * | 8/1988 | Danner | 248/164 |
| 4,903,847 | A | | 2/1990 | Duffy | 211/187 |
| 5,131,547 | A | * | 7/1992 | Goldberg | 211/149 |
| 5,205,421 | A | | 4/1993 | Bustos | 211/59.2 |
| 5,406,732 | A | * | 4/1995 | Peterson | 42/94 |
| 5,477,789 | A | | 12/1995 | Von Gunten | 108/108 |
| 5,848,498 | A | * | 12/1998 | Szabo et al. | 52/36.1 |
| 5,857,649 | A | * | 1/1999 | Eason | 248/164 |
| 5,899,346 | A | * | 5/1999 | Newkirk | 211/149 |
| 6,112,918 | A | * | 9/2000 | Burgess | 211/186 |

* cited by examiner

*Primary Examiner*—Daniel P. Stodola
*Assistant Examiner*—Jennifer E. Novosad
(74) *Attorney, Agent, or Firm*—Richard L. Miller

(57) ABSTRACT

A freestanding frame for supporting shelves that includes a pair of posts that extend upwardly from a carpeted horizontal surface and rest against a wall, and a pair of braces that extend from one post to the other post in an X configuration. Each post has an uppermost vertical member that rests against the wall, a horizontal member that extends forwardly from the uppermost vertical member, and a lowermost vertical member that depends from the horizontal member and sinks into the carpeted horizontal surface so as to prevent the post from sliding away from the wall while resting thereon. Each brace is either one piece or two-piece so as to be length adjustable. In a first embodiment, the two pieces are screwed together, and in a second embodiment, the two pieces slide relative to each other and are maintained at a desired length by first and second locking apparatuses.

20 Claims, 2 Drawing Sheets

FREESTANDING FRAME FOR SUPPORTING SHELVES

BACKGROUND OF THE INVENTION

1. Field of the Invention

The present invention relates to a frame for supporting shelves. More particularly, the present invention relates to a freestanding frame for supporting shelves.

2. Description of the Prior Art

Numerous innovations for shelving units have been provided in the prior art that will be described. Even though these innovations may be suitable for the specific individual purposes to which they address, however, they differ from the present invention.

A FIRST EXAMPLE, U.S. Pat. No. 3,655,159 to Held, Jr. teaches an improved base member for a freestanding shelving system comprised of two or more upright columns interconnected by lateral reinforcing members and supporting shelves at various heights. Each base member is formed with a pocket for receiving the lower end of an upright column and a locking means comprised of a pair of wedge members interconnected by a central wedge member that are manipulated to lock the column within the pocket. The base members are constructed to be utilized separately with decorative side panel attachments or to be connected by surrounding kickplate members.

A SECOND EXAMPLE, U.S. Pat. No. 4,197,950 to Ovitz, III teaches a display shelf having a front lip and a pair of side arms defining three sided enclosure for supporting an inside panel; brackets at the ends of the arms serve to cantilever the shelf on a pair of support bars.

A THIRD EXAMPLE, U.S. Pat. No. 4,620,489 to Albano teaches an extendible merchandise shelving display that embodies an elongated stationary shelf support which extends laterally from and is connected to at least one vertical support. An elongated, movable shelf support extends alongside and is slidably connected to the stationary shelf support. The movable shelf support is adapted for sliding movement relative to the stationary shelf support selectively to an extended position spaced from the vertical support and to a retracted position adjacent the vertical support. Cooperating locking members are carried by the movable and stationary shelf supports in position to engage each other and limit sliding movement of the movable shelf support while in it extended and retracted positions. An extendible shelf embodying a shelf-like member carried by the movable shelf support and at least two movable shelf-like elements carried by the stationary shelf support form a horizontal article supporting surface upon sliding movement of the movable shelf support to its extended position. The movable shelf-like elements pivot to generally upstanding positions adjacent the vertical support upon sliding movement of the movable shelf support to its retracted position.

A FOURTH EXAMPLE, U.S. Pat. No. 4,679,510 to Veyhl et al. teaches an office desk suited in particular for peripheral computer equipment that consists of two side parts formed by columns provided with feet, a longitudinal beam detachably connected with the columns by connection elements establishing a form-locking connection, and of carrying arms for at least one table top mounted on the longitudinal beam. These components can be varied in many different ways and combined in the most different manners so that office desks optimally adapted in each case to the respective application can be realized with the same basic elements.

A FIFTH EXAMPLE, U.S. Pat. No. 4,903,847 to Duffy teaches a library shelf assembly that has been designed to meet seismic code requirements for libraries in the state of California. The novel library shelf assembly has a tubular base support having a pair of right angularly shaped gussets welded to its top surface. The gussets have vertical edges that are spaced from each other a distance equal to the width of the post assembly that is received therebetween. A plurality of pairs of hat-shaped straps have their opposite ends bolted together thereby capturing the post assembly between the respective gussets. Anchor plates are welded on the opposite ends of the tubular base support for securing the base supports to a concrete or other type of floor structure. Conventional shelf brackets have their fingers detachably received in vertically oriented rows of spaced slots in the respective post assemblies. Standard shelves are connected between the respective shelf brackets.

A SIXTH EXAMPLE, U.S. Pat. No. 5,205,421 to Bustos teaches a gondola display rack for merchandising product that comprises a base having a top surface, at least one upright extending vertically from the rear of the base, and at least one shelf removably secured to the upright. Shelf supporting bracket means attach the shelf to the upright and include means for adjustment wherein the shelf may be positioned substantially horizontally or angled downwardly and forwardly, yet without any gap between the rear edge of the shelf and the upright as is typically experienced. The base includes adjustment means which allow the base top surface to be positioned substantially horizontally or angled downwardly and forwardly and which allows the depth of the base to be varied. The base further includes second adjustment means which allow the upright to be adjusted angularly with respect to the base.

A SEVENTH EXAMPLE, U.S. Pat. No. 5,477,789 to Von Gunten teaches a post including a back post and leg, together constituting a one-piece member. The member is bent to form the back post and leg, and when it is in upright active position, the back post rests against the wall, and the leg extends forwardly at an acute angle to the back post. A foot is secured to the lower end of the leg, extending transversely and engaging the floor. The back post is provided with holes for receiving brackets. There is no mechanical connection between the post and the wall or floor.

It is apparent that numerous innovations for shelving units have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a freestanding frame for supporting shelves that avoids the disadvantages of the prior art.

ANOTHER OBJECT of the present invention is to provide a freestanding frame for supporting shelves that is simple and inexpensive to manufacture.

STILL ANOTHER OBJECT of the present invention is to provide a freestanding frame for supporting shelves that is simple to use.

BRIEFLY STATED, STILL YET ANOTHER OBJECT of the present invention is to provide a freestanding frame for supporting shelves that includes a pair of posts that extend upwardly from a carpeted horizontal surface and rest against a wall, and a pair of braces that extend from one post to the other post in an X configuration. Each post has an uppermost vertical member that rests against the wall, a horizontal member that extends forwardly from the uppermost vertical member, and a lowermost vertical member that depends from the horizontal member and sinks into the carpeted horizontal surface so as to prevent the post from sliding away from the wall while resting thereon. Each brace is either one piece or two-piece so as to be length adjustable. In a first embodiment, the two pieces are screwed together, and in a second embodiment, the two pieces slide relative to each other and are maintained at a desired length by first and second locking apparatuses.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figure 1:
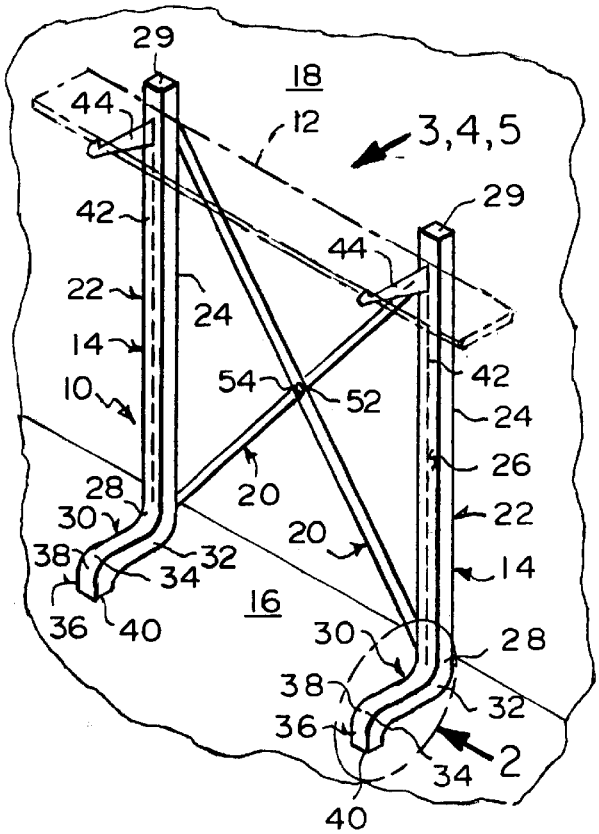
FIG. 1 is a diagrammatic perspective view of a first embodiment of the present invention in use.

10 freestanding frame of present invention for supporting shelves 12
12 shelves
14 pair of posts for extending upwardly from carpeted horizontal surface 16, for resting against wall 18, and for supporting shelves 12
16 carpeted horizontal surface
18 wall
20 pair of braces
22 uppermost vertical member of each post of pair of posts 14
24 rearwardmost surface of uppermost vertical member 22 of each post of pair of posts 14 for extending against wall 18
26 forwardmost surface of uppermost vertical member 22 of each post of pair of posts 14
28 lowermost end of uppermost vertical member 22 of each post of pair of posts 14 for positioning just above carpeted horizontal surface 16
29 uppermost end of uppermost vertical member 22 of each post of pair of posts 14
30 horizontal member of each post of pair of posts 14
32 rearwardmost end of horizontal member 30 of each post of pair of posts 14
34 forwardmost end of horizontal member 30 of each post of pair of posts 14
36 lowermost vertical member of each post of pair of posts 14
38 uppermost end of lowermost vertical member 36 of each post of pair of posts 14
40 lowermost end of lowermost vertical member 36 of each post of pair of posts 14 for sinking into carpeted horizontal surface 16 so as to prevent post 14 from sliding away from wall 18 while extending thereon
42 blindslots in forwardmost surface 26 of uppermost vertical member 22 of each post of pair of posts 14 for engaging brackets 44 to support shelves 12
44 brackets to support shelves 12
46 blindbores in rearwardmost surface 24 of uppermost vertical member 22 of each post of pair of posts 14
48 uppermost end of each brace of pair of braces 20
49 throughbore through uppermost end 48 of each brace of pair of braces 20
50 lowermost end of each brace of pair of braces 20
51 throughbore through lowermost end 50 of each brace of pair of braces 20
52 midpoint of each brace of pair of braces 20
54 throughbore through midpoint 52 of each brace of pair of braces 20
56 first screw
58 second screw
60 third screw
62 fourth screw
64 fifth screw

Second Embodiment

110 freestanding frame
114 pair of posts
120 pair of braces
146 blindbores in rearwardmost surface 124 of uppermost vertical member 122 of each post of pair of posts 114
150 lowermost end of each brace of pair of braces 120
166 lowermost member of each brace of pair of braces 120
167 uppermost member of each brace of pair of braces 120
168 uppermost end of lowermost member 166 of each brace of pair of braces 120
170 throughbores through uppermost end 168 of lowermost member 166 of each brace of pair of braces 120
172 throughbores through uppermost member 167 of each brace of pair of braces 120
174 pair of sixth screws

Third Embodiment

210 freestanding frame
220 pair of braces
248 uppermost end of each brace of pair of braces 220
250 lowermost end of each brace of pair of braces 220
252 midpoint of each brace of pair of braces 220
266 lowermost member of each brace of pair of braces 220
267 uppermost member of each brace of pair of braces 226
268 uppermost end of lowermost member 266 of each brace of pair of braces 220
276 lowermost end of uppermost member 267 of each brace of pair of braces 220
278 throughslot extending longitudinally along uppermost member 267 of each brace of pair of braces 220
280 throughslot extending longitudinally along lowermost member 266 of each brace of pair of braces 220

282 first locking apparatus
283 second locking apparatus
284 front plate of first locking apparatus 282
286 rearwardmost surface of front plate 284 of first locking apparatus 282
287 perimeter of rearwardmost surface 286 of front plate 284 of first locking apparatus 282
288 throughbore extending centrally through front plate 284 of first locking apparatus 282
290 blindslot extending diametrically across, and communicating with periphery 287 of, rearwardmost surface 286 of front plate 284 of first locking apparatus 282
292 back plate of first locking apparatus 282
294 forwardmost surface of back plate 292 of first locking apparatus 282
296 perimeter of forwardmost surface 294 of back plate 292 of first locking apparatus 282
298 throughbore extending centrally through back plate 292 of first locking apparatus 282
300 blindslot extending diametrically across, and communicating with periphery 296 of, forwardmost surface 294 of back plate 292 of first locking apparatus 282
302 first wing nut of first locking apparatus 282
304 bracket of each second locking apparatus of pair of second locking apparatuses 283 of each brace of pair of braces 220
305 open chamber contained in bracket 304 of each second locking apparatus of pair of second locking apparatuses 283 of each brace of pair of braces 220
306 front wall defining open chamber 305 contained in bracket 304 of each second locking apparatus of pair of second locking apparatuses 283 of each brace of pair of braces 220
308 pair of side edges of front wall 306 of bracket 304 of each second locking apparatus of pair of second locking apparatuses
283 of each brace of pair of braces 220
309 throughbore extending centrally through front wall 306 of bracket 304 of each second locking apparatus of pair of second locking apparatuses 283 of each brace of pair of braces 220
310 pair of side walls further defining open chamber 305 contained in bracket 304 of each second locking apparatus of pair of second locking apparatuses 283 of each brace of pair of braces 220
312 pair of rear edges of pair of side walls 310, respectively, of bracket 304 of each second locking apparatus of pair of second locking apparatuses 283 of each brace of pair of braces 220
314 pair of rear walls further defining open chamber 305 contained in bracket 304 of each second locking apparatus of pair of second locking apparatuses 283 of each brace of pair of braces 220
316 pair of free edges of pair of rear walls 314, respectively, of bracket 304 of each second locking apparatus of pair of second locking apparatuses 283 of each brace of pair of braces 220
318 seventh screw of each second locking apparatus of pair of second locking apparatuses 283 of each brace of pair of braces 220
320 washer of each second locking apparatus of pair of second locking apparatuses 283 of each brace of pair of braces 220
322 second wing nut of each second locking apparatus of pair of second locking apparatuses 283 of each brace of pair of braces 220

DETAILED DESCRIPTION OF THE PREFERRED EMBODIMENT

Referring now to the figures, in which like numerals indicate like parts, and particularly to FIG. 1, a first embodiment of the freestanding frame of the present invention is shown generally at 10 for supporting shelves 12.

Figure 2:
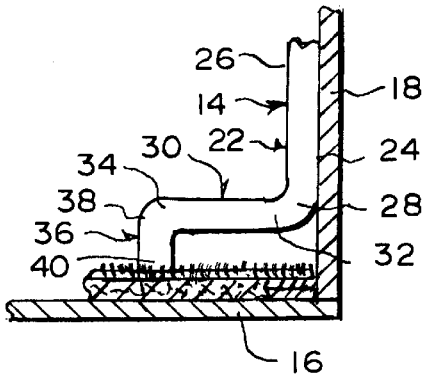
FIG. 2 is an enlarged diagrammatic side elevational view of the area generally enclosed by the dotted curve identified by arrow 2 in FIG. 1.
Figure 3:
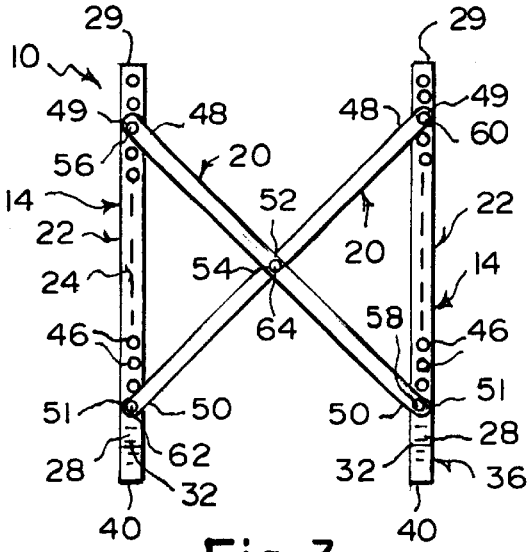
FIG. 3 is a diagrammatic rear elevational view taken generally in the direction of arrow 3 in FIG. 1.

The configuration of the freestanding frame 10 can best be seen in FIGS. 1–3, and as such, will be discussed with reference thereto.

The freestanding frame 10 comprises a pair of posts 14 for extending upwardly from a carpeted horizontal surface 16, for resting against a wall 18, and for supporting the shelves 12.

The freestanding frame 10 further comprises a pair of braces 20 that extend from one post 14 to the other post 14 in an X configuration.

The pair of posts 14 are identical to, spaced-apart from, and parallel to, each other.

Each post 14 has an uppermost vertical member 22 that is slender, elongated, and has a rearwardmost surface 24 for extending against the wall 18, a forwardmost surface 26, a lowermost end 28 for positioning just above the carpeted horizontal surface 16, and an uppermost end 29.

Each post 14 further has a horizontal member 30 that is slender, elongated, and has a rearwardmost end 32 and a forwardmost end 34.

The rearwardmost end 32 of the horizontal member 30 is coincident with the lowermost end 28 of the uppermost vertical member 22, with the horizontal member 30 extending perpendicularly forwardly from the uppermost vertical member 22 and is for being parallel to, and disposing just above, the carpeted horizontal surface 16.

Each post 14 further has a lowermost vertical member 36 that is slender, elongated, and has an uppermost end 38 and a lowermost end 40 for sinking into the carpeted horizontal surface 16 so as to prevent the post 14 from sliding away from the wall 18 while extending along the wall 18.

The uppermost end 38 of the lowermost vertical member 36 is coincident with the forwardmost end 34 of the horizontal member 30, with the lowermost vertical member 36 depending perpendicularly from the horizontal member 30, being parallel to the uppermost vertical member 22, and for being perpendicular to the carpeted horizontal surface 16.

The lowermost vertical member 36 is much shorter than the uppermost vertical member 22, while the horizontal member 30 is much shorter than the uppermost vertical member 22, but only slightly longer than the lowermost vertical member 36.

The horizontal member 30 meets the uppermost vertical member 22 in a concavity to provide a smooth transition, while the horizontal member 30 meets the lowermost member 36 in a convexity to provide a smooth transition.

The forwardmost surface 26 of the uppermost vertical member 22 of each post 14 has blindslots 42 that extend vertically therealong, are spaced vertically-apart, and are for engaging brackets 44 to support the shelves 12.

The rearwardmost surface 24 of the uppermost vertical member 22 of each post 14 has blindbores 46 that extend therealong and are spaced vertically-apart.

The pair of braces 20 are identical to each other.

Each brace 20 is slender, elongated, and has an uppermost end 48 with a throughbore 49, a lowermost end 50 with a throughbore 51, and a midpoint 52 that is midway between the uppermost end 48 thereof and the lowermost end 50 thereof and has a throughbore 54.

The uppermost end 48 of one brace 20 is attached to the uppermost vertical member 22 of one post 14, in proximity of the uppermost end 29 of the uppermost vertical member 22 of the one post 14, the lowermost end 50 of the one brace 20 is attached to the uppermost vertical member 22 of the other post 14, in proximity of the lowermost end 28 of the uppermost vertical member 22 of the other post 14, the uppermost end 48 of the other brace 20 is attached to the uppermost vertical member 22 of the other post 14, in proximity of the uppermost end 29 of the uppermost vertical member 22 of the other post 14, the lowermost end 50 of the other brace 20 is attached to the uppermost vertical member 22 of the one post 14, in proximity of the lowermost end 28 of the uppermost vertical member 22 of the one post 14, and the midpoint 52 of the one brace 20 overlies the midpoint 52 of the other brace 20.

The uppermost end 48 of the one brace 20 is attached to the uppermost vertical member 22 of the one post 14, in proximity of the uppermost end 29 of the uppermost vertical member 22 of the one post 14 by a first screw 56 that extends into the throughbore 49 in the uppermost end 48 of the one brace 20 and into an appropriate one of the blindbores 46 in the rearwardmost surface 24 of the uppermost vertical member 22 of the one post 14.

The lowermost end 50 of the one brace 20 is attached to the uppermost vertical member 22 of the other post 14, in proximity of the lowermost end 28 of the uppermost vertical member 22 of the other post 14 by a second screw 58 that extends into the throughbore 51 in the lowermost end 50 of the one brace 20 and into an appropriate one of the blindbores 46 in the rearwardmost surface 24 of the uppermost vertical member 22 of the other post 14.

The uppermost end 48 of the other brace 20 is attached to the uppermost vertical member 22 of the other post 14, in proximity of the uppermost end 29 of the uppermost vertical member 22 of the other post 14 by a third screw 60 that extends into the throughbore 49 in the uppermost end 48 of the other brace 20 and into an appropriate one of the blindbores 46 in the rearwardmost surface 24 of the uppermost vertical member 22 of the other post 14.

The lowermost end 50 of the other brace 20 is attached to the uppermost vertical member 22 of the one post 14, in proximity of the lowermost end 28 of the uppermost vertical member 22 of the one post 14 by a fourth screw 62 that extends into the throughbore 51 in the lowermost end 50 of the other brace 20 and into an appropriate one of the blindbores 46 in the rearwardmost surface 24 of the uppermost vertical member 22 of the one post 14.

The one brace 20 is attached to the other brace 20 by a fifth screw 64 that extends into the throughbore 54 in the midpoint 52 of the one brace 20 and into the throughbore 54 in the midpoint 52 of the other brace 20.

Each brace 20 is one piece.

The configuration of a second embodiment of the freestanding frame 110 can best be seen in FIG. 4, and as such, will be discussed with reference thereto.

The freestanding frame 110 is similar to the freestanding frame 10, except that each of the pair of braces 120 is length adjustable so as to reduce the number of blindbores 146 in the rearwardmost surface 124 of the uppermost vertical member 122 of each post 114 necessary to achieve a desired distance between the pair of posts 114.

Each brace 120 has a lowermost member 166 and an uppermost member 167 that extends colinearly from, and overlaps, the lowermost member 166 of an associated brace 120 so as to allow each brace 120 to be length adjustable.

The lowermost member 166 of each brace 126 extends from the lowermost end 150 of an associated brace 120, past the midpoint 152 of the associated brace 120, to an uppermost end 168 thereof.

The uppermost member 167 of each brace 120 extends overlappingly and colinearly from the uppermost end 168 of the lowermost member 66 of an associated brace 120 to the uppermost end 148 of the associated brace 120.

The uppermost end 168 of the lowermost member 166 of each brace 120 has throughbores 170 that are spaced longitudinally therealong.

The uppermost member 167 of each brace 120 has throughbores 172 that are spaced longitudinally therealong and are alignable with the throughbores 170 through the uppermost end 168 of the lowermost member 166 of an associated brace 120.

The lowermost member 166 of an associated brace 120 is attached to the uppermost member 167 of each brace 120 by a pair of sixth screws 174 that extend into an appropriate pair of the throughbores 170 through the uppermost end 168 of the lowermost member 166 of an associated brace 120 and into an aligned pair of the throughbores 172 through the uppermost member 167 of the associated brace 120.

The general configuration of a third embodiment of the freestanding frame 210 can best be seen in FIG. 5, and as such, will be discussed with reference thereto.

Figure 4:
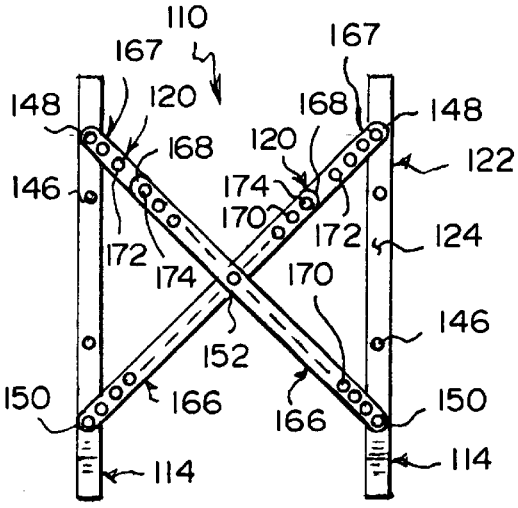
FIG. 4 is a diagrammatic rear elevational view taken generally in the direction of arrow 4 in FIG. 1 of a second embodiment of the present invention.
Figure 5:
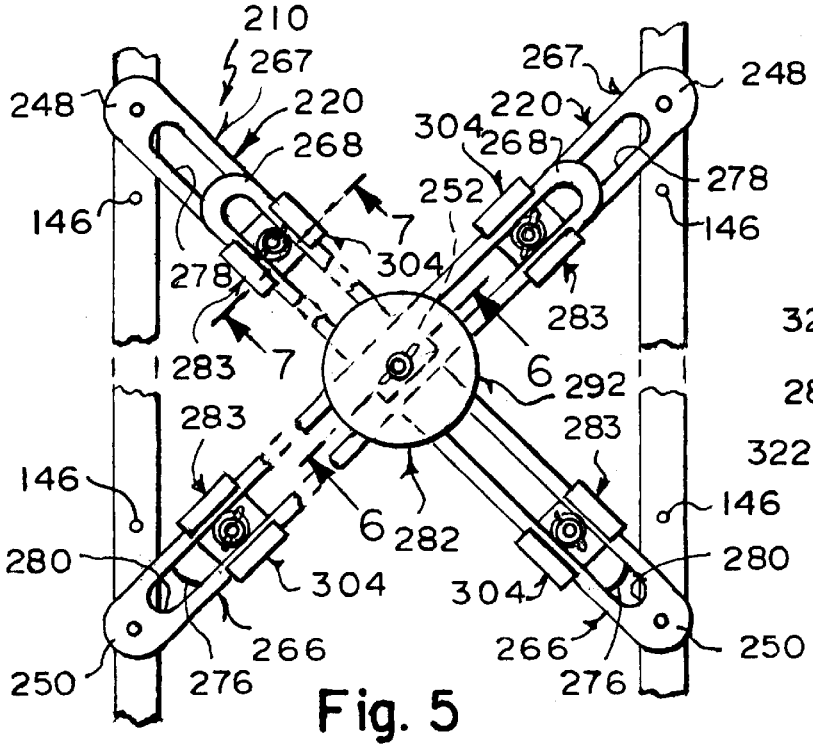
FIG. 5 is a diagrammatic rear elevational view taken generally in the direction of arrow 5 in FIG. 1 of a third embodiment of the present invention.

The freestanding frame 210 is similar to the freestanding frame 110 and the posts in FIG. 5 are identical to those in FIG. 4 and include the same number of blindbores as those of FIG. 4, except that:

1. The uppermost member 267 and the lowermost member 266 of each brace 220 are identical to each other and each has a width and a thickness.
2. The uppermost member 267 of each brace 220 depends from the uppermost end 248 of an associated brace 220, past the midpoint 252 of the associated brace 220, to a lowermost end 276 thereof.
3. The uppermost member 267 of each brace 220 has a throughslot 278 that extends longitudinally therethrough, from just inward of the uppermost end 248 of an associated brace 220 to just inward of the lowermost end 276 of the uppermost member 267 of the associated brace 220.
4. The lowermost member 266 of each brace 220 has a throughslot 280 that extends longitudinally therethrough, from just inward of the lowermost end 250 of an associated brace 220 to just inward of the uppermost end 268 of the lowermost member 266 of the associated brace 220.
5. The pair of braces 220 are attached to each other, at their midpoints 252 by first locking apparatus 282.
6. The uppermost member 267 and the lowermost member 266 of each brace 220 are slidably attached to each other by a pair of second locking apparatuses 283.

Figure 6:
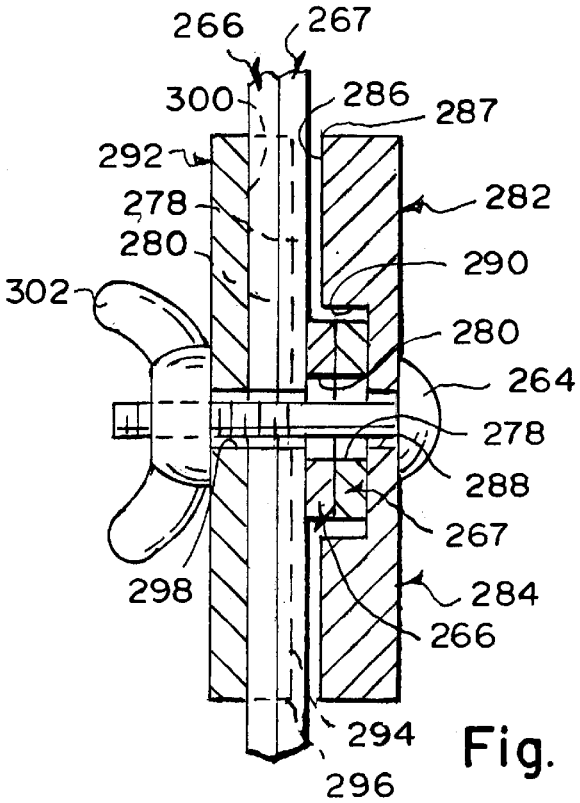
FIG. 6 is an enlarged diagrammatic cross sectional view taken on line 6—6 in FIG. 5.

The specific configuration of the first locking apparatus 282 can best be seen in FIGS. 5 and 6, and as such, will be discussed with reference thereto.

The first locking apparatus 282 comprises a front plate 284 that is disk-shaped and has a rearwardmost surface 286 with a perimeter 287, a throughbore 288 that extends centrally therethrough, and a blindslot 290 that has a depth, a width, and extends diametrically across, and communicates with the periphery 287 of, the rearwardmost surface 286 of the front plate 284.

The blindslot 290 in the rearwardmost surface 286 of the front plate 284 slidingly receives the uppermost member 267 and the lowermost member 266 of one brace 220 that overlaps the uppermost member 267 of the one brace 220.

The depth of the blindslot 290 in the rearwardmost surface 286 of the front plate 284 is less than the thickness of the uppermost member 267 and the lowermost member 266 combined of one brace 220 so as to provide sliding clearance between the other brace 220 and the front plate 284.

The width of the blindslot 290 in the rearwardmost surface 286 of the front plate 284 is greater than the width of the uppermost member 267 and the lowermost member 266 of one brace 220 so as to provide sliding clearance between the uppermost member 267 and the lowermost member 266 of the one brace 220 and the front plate 284.

The first locking apparatus 282 further comprises a back plate 292 that is disk-shaped and has a forwardmost surface 294 with a perimeter 296, a throughbore 298 that extends centrally therethrough, and a blindslot 300 that has a depth, a width, and extends diametrically across, and communicates with the periphery 296 of, the forwardmost surface 294 of the back plate 292.

The blindslot 300 in the forwardmost surface 294 of the back plate 292 slidingly receives the lowermost member 266 and the uppermost member 267 of the other brace 220 that overlaps the lowermost member 266 of the other brace 220.

The depth of the blindslot 300 in the forwardmost surface 294 of the back plate 292 is less than the thickness of the lowermost member 266 and the uppermost member 267 combined of the other brace 220 so as to provide sliding clearance between the one brace 220 and the back plate 292.

The width of the blindslot 300 in the forwardmost surface 294 of the back plate 292 is greater than the width of the lowermost member 266 and the uppermost member 267 of the other brace 220 so as to provide sliding clearance between the lowermost member 266 and the uppermost member 267 of the other brace 220 and the back plate 292.

The fifth screw 264 extends freely into the throughbore 288 through the front plate 284, the throughslot 278 through the uppermost member 267 of the one brace 220, the throughslot 280 through the lowermost member 266 of the one brace 220, the throughslot 278 through the uppermost member 267 of the other brace 220, the throughslot 280 through the lowermost member 266 of the other brace 220, the throughbore 298 through the back plate 292, and threadably into a first wing nut 302.

Figure 7:
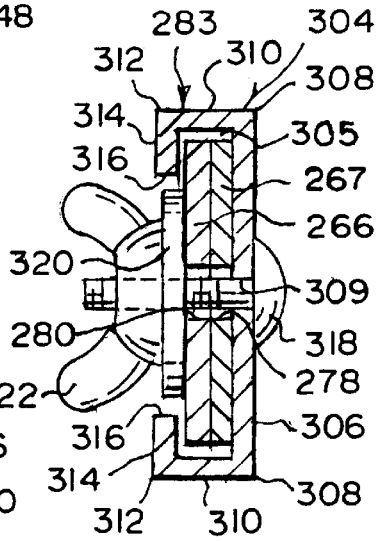
FIG. 7 is an enlarged diagrammatic cross sectional view taken on line 7—7 in FIG. 5.

The specific configuration of the pair of second locking apparatuses 283 can best be seen in FIGS. 5 and 7, and as such, will be discussed with reference thereto.

The pair of second locking apparatuses 283 of each brace 220 straddle the first locking apparatus 282.

Each second locking apparatus 283 comprises a bracket 304 that is C-shaped.

The bracket 304 of each second locking apparatus 283 contains an open chamber 305 that is defined by a front wall 306 with a width, a pair of side edges 308, and a throughbore 309 that extends centrally therethrough, a pair of side walls 310 that have heights and extend perpendicularly rearwardly from the pair of side edges 308 of the front wall 306, respectively, to a pair rear edges 312, respectively, and a pair of rear walls 314 that extend perpendicularly inwardly from the pair of rear edges 312 of the pair of side walls 310, respectively, to a pair of free edges 316, respectively, that are spaced-apart from each other.

The pair of rear walls 314 of the bracket 304 are coplanar with each other and parallel to the front wall 306 of the bracket 304, and the pair of side walls of the bracket 304 are parallel to each other.

The open chamber 305 in the bracket 304 slidingly receives the uppermost member 267 and the lowermost member 266 of an associated brace 220 that overlaps the uppermost member 267 of the associated brace 220.

The height of each of the pair of side walls 310 of the bracket 304 is greater than the thickness of the uppermost member 267 and the lowermost member 266 of an associated brace 220 combined and the width of the front all 306 of the bracket 304 is greater than the width of the uppermost member 267 and the lowermost member 266 of the associated brace 220 so as to provide sliding clearance between the associated brace 220 and the bracket 304.

Each second locking apparatus 283 further comprises a seventh screw 318 that extends freely into the throughbore 309 through the front wall 306 of the bracket 304, the throughslot 278 through the uppermost member 267 of an associated brace 220, the throughslot 280 through the lowermost member 266 of the associated brace 220, a washer 320, and threadably into a second wing nut 322.

It will be understood that each of the elements described above, or two or more together, may also find a useful application in other types of constructions differing from the types described above.

While the invention has been illustrated and described as embodied in a freestanding frame for supporting shelves, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A freestanding frame for supporting shelves, comprising a pair of posts;

wherein said pair of posts are for extending upwardly from a carpeted horizontal surface;

wherein said pair of posts are for resting against a wall; and wherein said pair of posts are for supporting the shelves; further comprising a pair of braces;

wherein said pair of braces extend from one post to the other post;

wherein said pair of braces extend in an X configuration, wherein each post has an uppermost vertical member;

wherein said uppermost member is slender;

wherein said uppermost member is elongated;

wherein said uppermost member has a rearwardmost surface;

wherein said rearwardmost surface of said uppermost member is for extending against the wall;

wherein said uppermost member has a forwardmost surface;

wherein said uppermost member has a lowermost end;

wherein said lowermost end of said uppermost member is for positioning just above the carpeted horizontal surface;

wherein said uppermost member has an uppermost end, wherein each brace is slender;

wherein each brace is elongated;

wherein each brace has an uppermost end;

wherein said uppermost end of each brace has a throughbore;

wherein each brace has a lowermost end;

wherein said lowermost end of each brace has a throughbore;

wherein each brace has a midpoint;

wherein said midpoint of each brace is midway between said uppermost end thereof and said lowermost end thereof;

wherein said midpoint of each brace has a throughbore, wherein said uppermost end of one brace is attached to said uppermost vertical member of one post, in proximity of said uppermost end of said uppermost vertical member of said one post by a first screw;

wherein said first screw extends into said throughbore in said uppermost end of said one brace and into a selected one of a plurality of blindbores in said rearwardmost surface of said uppermost vertical member of said one post;

wherein said lowermost end of said one brace is attached to said uppermost vertical member of the other post, in proximity of said lowermost end of said uppermost vertical member of said other post by a second screw;

wherein said second screw extends into said throughbore in said lowermost end of said one brace and into a selected one of a plurality of blindbores in said rearwardmost surface of said uttermost vertical member of said other post;

wherein said uppermost end of the other brace is attached to said uppermost vertical member of said other post, in proximity of said uppermost end of said uppermost vertical member of said other post by a third screw;

wherein said third screw extends into said throughbore in said uppermost end of said other brace and into a selected one of said blindbores in said rearwardmost surface of said uppermost vertical member of said other post;

wherein said lowermost end of said other brace is attached to said uppermost vertical member of said one post, in proximity of said lowermost end of said uppermost vertical member of said one post by a fourth screw; and wherein said fourth screw extends into said throughbore in said lowermost end of said other brace and into a selected one of said blindbores in said rearwardmost surface of said uppermost vertical member of said one post, wherein said one brace is attached to said other brace by a fifth screw;

wherein said fifth screw extends into said throughbore in said midpoint of said one brace and into said throughbore in said midpoint of said other brace, wherein each brace has a lowermost member;

wherein each brace has an uppermost member;

wherein said undermost member of each brace extends colinearly from said lowermost member of an associated brace; and wherein said uttermost member of each brace overlaps said lowermost member of an associated brace, wherein said lowermost member of each brace extends from said lowermost end of an associated brace, past said midpoint of said associated brace, to an uppermost end of each brace, wherein said uppermost member of each brace has a throughslot;

wherein said throughslot extends longitudinally through said uppermost member of each brace, from just inward of said uppermost end of an associated brace to just inward of said lowermost end of said uppermost member of said associated brace, wherein said lowermost member of each brace has a throughslot;

wherein said throughslot extends longitudinally through said lowermost member of each brace, from just inward of said lowermost end of an associated brace to just inward of said uppermost end of said lowermost member of said associated brace, wherein said uppermost member and said lowermost member of each brace are slidably attached to each other by a pair of second locking apparatuses.

2. The frame as defined in claim 1, wherein said uppermost member and said lowermost member of each brace are identical to each other;

wherein said uppermost member and said lowermost member of each brace has a width; and wherein said uppermost member and said lowermost member of each brace has a thickness.

3. The frame as defined in claim 1, wherein said uppermost member of each brace depends from said uppermost end of an associated brace, past said midpoint of said associated brace, to a lowermost end thereof.

4. The frame as defined in claim 1, wherein each second locking apparatus comprises a bracket; and wherein said bracket is C-shaped.

5. The frame as defined in claim 4, wherein said bracket of each second locking apparatus contains an open chamber;

wherein said open chamber of said bracket is defined by a front wall;

wherein said front wall of said bracket has a width;

wherein said front wall of said bracket has a pair of side edges;

wherein said front wall of said bracket has a throughbore;

wherein said throughbore extends centrally through said front wall of said bracket;

wherein said open chamber of said bracket is defined by a pair of side walls;

wherein said pair of side walls of said bracket have heights;

wherein said pair of side walls of said bracket extend perpendicularly rearwardly from said pair of side edges of said front wall;

wherein said open chamber of said bracket is defined by a pair of rear walls;

wherein said pair of rear walls of said bracket extend perpendicularly inwardly from said pair of rear edges of said pair of side walls, respectively, to a pair of free edges, respectively; and wherein said pair of free edges of said pair of rear walls of said bracket, respectively, are spaced-apart from each other.

6. The frame as defined in claim 5, wherein said pair of rear walls of said bracket are coplanar with each other;

wherein said pair of rear walls of said bracket are parallel to said front wall of said bracket; and wherein said pair of side walls of said bracket are parallel to each other.

7. The frame as defined in claim 5, wherein said open chamber in said bracket slidingly receives said uppermost member and said lowermost member of an associated brace that overlaps said uppermost member of said associated brace.

8. The frame as defined in claim 5, wherein said height of each of said pair of side walls of said bracket is greater than said thickness of said uppermost member and said lowermost member of an associated brace combined and said width of said front all of said bracket is greater than said width of said uppermost member and said lowermost member of said associated brace so as to provide sliding clearance between said associated brace and said bracket.

9. The frame as defined in claim 5, wherein each second locking apparatus comprises a seventh screw; and wherein said seventh screw extends freely into said throughbore through said front wall of said bracket, said throughslot through said uppermost member of an associated brace, said throughslot through said lowermost member of said associated brace, a washer, and threadably into a second wing nut.

10. A freestanding frame for suturing shelves, comprising a pair of posts;

wherein said pair of posts are for extending upwardly from a carpeted horizontal surface;

wherein said pair of posts are for resting against a wall; and wherein said pair of posts are for supporting the shelves; further comprising a pair of braces;

wherein said pair of braces extend from one post to the other post;

wherein said air of braces extend in an X configuration, wherein each post has an uppermost vertical member;

wherein said uppermost member is slender;

wherein said uppermost member is elongated;

wherein said uppermost member has a rearwardmost surface;

wherein said rearwardmost surface of said uppermost member is for extending against the wall;

wherein said uppermost member has a forwardmost surface;

wherein said uppermost member has a lowermost end;

wherein said lowermost end of said uppermost member is for positioning just above the carpeted horizontal surface;

wherein said uppermost member has an uppermost end, wherein each brace is slender;

wherein each brace is elongated;

wherein each brace has an uppermost end;

wherein said uppermost end of each brace has a throughbore;

wherein each brace has a lowermost end;

wherein said lowermost end of each brace has a throughbore;

wherein each brace has a midpoint;

wherein said midpoint of each brace is midway between said uppermost end thereof and said lowermost end thereof;

wherein said midpoint of each brace has a throughbore, wherein said uppermost end of one brace is attached to said uppermost vertical member of one post, in proximity of said uppermost end of said uppermost vertical member of said one post by a first screw;

wherein said first screw extends into said throughbore in said uppermost end of said one brace and into a selected one of a plurality of blindbores in said rearwardmost surface of said uppermost vertical member of said one post;

wherein said lowermost end of said one brace is attached to said uppermost vertical member of the other post, in proximity of said lowermost end of said uppermost vertical member of said other lost by a second screw;

wherein said second screw extends into said throughbore in said lowermost end of said one brace and into a selected one of a plurality of blindbores in said rearwardmost surface of said uppermost vertical member of said other post;

wherein said uppermost end of the other brace is attached to said uppermost vertical member of said other post, in proximity of said uppermost end of said uppermost vertical member of said other post by a third screw;

wherein said third screw extends into said throughbore in said uppermost end of said other brace and into a selected one of said blindbores in said rearwardmost surface of said uppermost vertical member of said other post;

wherein said lowermost end of said other brace is attached to said uppermost vertical member of said one post, in proximity of said lowermost end of said uppermost vertical member of said one post by a fourth screw; and wherein said fourth screw extends into said throughbore in said lowermost end of said other brace and into a selected one of said blindbores in said rearwardmost surface of said uppermost vertical member of said one post, wherein said one brace is attached to said other brace by a fifth screw;

wherein said fifth screw extends into said throughbore in said midpoint of said one brace and into said throughbore in said midpoint of said other brace, wherein each brace has a lowermost member;

wherein each brace has an uppermost member;

wherein said uppermost member of each brace extends colinearly from said lowermost member of an associated brace; and wherein said uppermost member of each brace overlaps said lowermost member of an associated brace, wherein said lowermost member of each brace extends from said lowermost end of an associated brace, past said midpoint of said associated brace, to an uppermost end of each brace, wherein said uppermost member of each brace has a throughslot;

wherein said throughslot extends longitudinally through said uppermost member of each brace, from just inward of said uppermost end of an associated brace to lust inward of said lowermost end of said uppermost member of said associated brace, wherein said lowermost member of each brace has a throughslot;

wherein said throughslot extends longitudinally through said lowermost member of each brace, from just inward of said lowermost end of an associated brace to just inward of said uppermost end of said lowermost member of said associated brace, wherein said pair of braces are attached to each other, at their midpoints by a first locking apparatus, wherein said first locking apparatus comprises a front plate;

wherein said front plate is disk-shaped;

wherein said front plate has a rearwardmost surface;

wherein said rearwardmost surface of said front plate has a perimeter;

wherein said front plate has a throughbore;

wherein said throughbore extends centrally through said front plate;

wherein said front plate has a blindslot;

wherein said blindslot has a depth;

wherein said blindslot has a width; and wherein said blindslot extends diametrically across, and wherein said blindslot extends diametrically across to said periphery of said rearwardmost surface of said front plate.

11. The frame as defined in claim 10, wherein said blindslot in said rearwardmost surface of said front plate slidingly receives said uppermost member and said lowermost member of one brace that overlaps said uppermost member of said one brace.

12. The frame as defined in claim 10, wherein said depth of said blindslot in said rearwardmost surface of said front plate is less than said thickness of said uppermost member and said lowermost member combined of one brace so as to provide sliding clearance between the other brace and said front plate.

13. The frame as defined in claim 10, wherein said width of said blindslot in said rearwardmost surface of said front plate is greater than said width of said uppermost member and said lowermost member of one brace so as to provide sliding clearance between said uppermost member and said lowermost member of said one brace and said front plate.

14. The frame as defined in claim 10, wherein said first locking apparatus comprises a back plate;

wherein said back plate is disk-shaped;

wherein said back plate has a forwardmost surface;

wherein said forwardmost surface of said back plate has a perimeter;

wherein said back plate has a throughbore;

wherein said throughbore extends centrally through said back plate;

wherein said back plate has a blindslot;

wherein said blindslot has a depth;

wherein said blindslot has a width; and wherein said blindslot extends diametrically across to said periphery of said forwardmost surface of said back plate.

15. The frame as defined in claim 14, wherein said blindslot in said forwardmost surface of said back plate slidingly receives said lowermost member and said uppermost member of the other brace that overlaps said lowermost member of said other brace.

16. The frame as defined in claim 14, wherein said depth of said blindslot in said forwardmost surface of said back plate is less than said thickness of said lowermost member and said uppermost member combined of the other brace so as to provide sliding clearance between said one brace and said back plate.

17. The frame as defined in claim 14, wherein said width of said blindslot in said forwardmost surface of said back plate is greater than said width of said lowermost member and said uppermost member of the other brace so as to provide sliding clearance between said lowermost member and said uppermost member of said other brace and said back plate.

18. The frame as defined in claim 14, wherein said fifth screw extends freely into said throughbore of said front plate, said throughslot of said uppermost member of one brace, said throughslot of said lowermost member of said one brace, said throughslot of said uppermost member of the other brace, said throughslot of said lowermost member of said other brace, said throughbore of said back plate, and threadably into a first wing nut.

19. The frame as defined in claim 10, wherein said uppermost member and said lowermost member of each brace are identical to each other;

wherein said uppermost member and said lowermost member of each brace has a width; and wherein said uppermost member and said lowermost member of each brace has a thickness.

20. The frame as defined in claim 10, wherein said uppermost member of each brace depends from said uppermost end of an associated brace, past said midpoint of said associated brace, to a lowermost end thereof.

* * * * *